US006026913A

United States Patent [19]

Mandal et al.

[11] Patent Number: 6,026,913

[45] Date of Patent: Feb. 22, 2000

[54] ACOUSTIC METHOD OF CONNECTING BOREHOLES FOR MULTI-LATERAL COMPLETION

[75] Inventors: Batakrishna Mandal, Missouri City; John W. Minear, Houston; James Robert Birchak, Spring, all of Tex.

[73] Assignee: Halliburton Energy Services, Inc., Houston, Tex.

[21] Appl. No.: 08/940,352

[22] Filed: Sep. 30, 1997

[51] Int. Cl.[7] ..... E21B 47/02

[52] U.S. Cl. ..... 175/45

[58] Field of Search ..... 175/41, 45; 367/97, 367/99, 117

[56] References Cited

U.S. PATENT DOCUMENTS

| | | | |
|---|---|---|---|
| 3,876,016 | 4/1975 | Stinson | 175/45 |
| 4,016,942 | 4/1977 | Wallis, Jr. et al. | 175/45 |
| 4,458,767 | 7/1984 | Hoehn, Jr. | 175/45 |
| 5,258,755 | 11/1993 | Kuckes | 175/45 |
| 5,467,832 | 11/1995 | Orban et al. | 175/45 |
| 5,589,775 | 12/1996 | Kuckes | 175/45 |

*Primary Examiner*—William Neuder
*Attorney, Agent, or Firm*—Conley, Rose & Tayon

[57] ABSTRACT

The invention is a device and related method of finding from at least one receiver the location of a source of a transmitted acoustic signal. Both signal source and signal receiver are downhole. The invention uses either or both the triangulation method and the holographic method to determine signal location.

The triangulation technique uses the relationships existing in Pythagorean's theorem to find source location. In contrast, the holographic technique uses a known velocity structure to assign propagation velocities to volume cells surrounding the receiver. By variational calculus, a ray path and start time may be assigned to a hypothetical source location for a particular receiver position. This is repeated for each receiver position. Where the hypothetical source locations and start times match for multiple receiver locations, the likely position of a source has been found.

21 Claims, 14 Drawing Sheets

ACOUSTIC METHOD OF CONNECTING BOREHOLES FOR MULTI-LATERAL COMPLETION

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to a telemetry unit used with a downhole drilling system. More specifically, this invention relates to a downhole telemetry unit that is capable of locating an underground signal source based upon the received waveform. Still more specifically, the present invention relates to a system and method that precisely locates an underground signal source and reconstructs the signal path of the acoustic wave from the source to a downhole telemetry device.

2. Description of the Related Art

Modern petroleum drilling and production operations demand a great quantity of information relating to parameters and conditions downhole. By using this information, the driller is able to more precisely determine the orientation of the bottomhole assembly and the type of formation through which the bottomhole assembly formation is drilling. The collection of information relating to conditions downhole, commonly referred to as "logging," can be performed by several methods. Oil well logging has been known in the industry for many years as a technique for providing information to a driller regarding the particular earth formation being drilled. In conventional oil well wireline logging, a probe or "sonde" is lowered into the borehole after some or all of the well has been drilled, and is used to determine certain characteristics of the formations traversed by the borehole. The sonde may include one or more sensors to measure parameters downhole and typically is constructed as a hermetically sealed steel cylinder for housing the sensors, which hangs at the end of a long cable or "wireline." The cable or wireline provides mechanical support to the sonde and also provides an electrical connection between the sensors and associated instrumentation within the sonde and electrical equipment located at the surface of the well. Normally, the cable supplies operating power to the sonde and is used as an electrical conductor to transmit information signals from the sonde to the surface. In accordance with conventional techniques, various parameters of the earth's formations are measured and correlated with the position of the sonde in the borehole as the sonde is pulled uphole.

While wireline logging is useful in assimilating information relating to formations downhole, it nonetheless has certain disadvantages. For example, before the wireline logging tool can be run in the wellbore, the drill string must first be removed or tripped from the borehole, resulting in considerable cost and loss of drilling time for the driller (who typically is paying daily fees for the rental of drilling equipment). In addition, because wireline tools are unable to collect data during the actual drilling operation, drillers must make some decisions (such as the direction to drill, etc.) without sufficient information, or else incur the cost of tripping the drill string to run a logging tool to gather more information relating to conditions downhole. In addition, because wireline logging occurs a relatively long period after the wellbore is drilled, the accuracy of the wireline measurement is questionable as drilling mud begins to invade the formation surrounding the borehole.

Because of these limitations associated with wireline logging, there has been an increasing emphasis on the collection of data during the drilling process itself. By collecting and processing data during the drilling process, without the necessity of tripping the drilling assembly to insert a wireline logging tool, the driller can make accurate modifications or corrections "real-time", as necessary, to optimize performance. Moreover, the measurement of formation parameters during drilling increases the integrity of the measured data. Designs for measuring conditions downhole and the movement and location of the drilling assembly, contemporaneously with the drilling of the well, have come to be known as "measurement-while-drilling" techniques, or "MWD." Similar techniques, concentrating more on the measurement of formation parameters, commonly have been referred to as "logging while drilling" techniques, or "LWD." While distinctions between MWD and LWD may exist, the terms MWD and LWD often are used interchangeably. For the purposes of this disclosure, the term LWD will be used with the understanding that the term encompasses both the collection of formation parameters and the collection of information relating to the movement and position of the drilling assembly while the bottomhole assembly is in the well.

The measurement of formation properties during drilling of the well by LWD systems increases the timeliness of measured data and, consequently, increases the efficiency of drilling operations. While LWD data is valuable in any well, those in the oil industry have realized the special importance of LWD data in wells drilled with a steerable bottomhole assembly, as described in assignee's U.S. Pat. No. RE 33,751. Extraneous noise downhole greatly complicates the implementation of acoustic logging tools in a LWD system. Thus, the noise generated by drilling, the flow of mud through the drill string, the grinding of the drilling components, and other mechanical and environment noises present downhole interfere with the reception and isolation of transmitted acoustic waves.

Logging sensors commonly used as part of an LWD system are resistivity, gamma ray, gamma density, and neutron porosity sensors. The assignee and other companies are currently experimenting with and implementing acoustic measurement devices to determine the properties of the formation surrounding LWD systems. Two types of suitable acoustic sensors are hydrophones and triaxial geophones. As is well known in the art, while a hydrophone may be used in the drill string, the type of information that can be detected with a hydrophone is limited to the measurement of pressure variations in fluids. In contrast, a geophone with three-dimensional capabilities provides more information, but must maintain contact with the wall of the well bore.

Modem petroleum drilling and production operations often require drilling from one well towards another well in which case the target well must be found and hit. Other applications require drilling one well while staying a specified distance away from another well in which case the second well must be found and tracked.

FIG. 1 shows a plan for joining two adjacent wells with well 110 being drilled while well 100 is the target. The inherent difficulties of joining wells 100 and 110 head-on can be appreciated. The target well 100 may only be 5 inches in diameter, the borehole from which well 110 is drilled may initially be over a mile away, and the intended intersection point may be five miles below the earth's surface.

The reasons for joining two wells vary. For example, two wells may be joined to increase production, thermal energy, or simply as a method of laying pipeline. Alternately, two wells may need joining to kill an old well. For example, as shown in FIG. 2, salt water may be leaking through an old casing contaminating a fresh water aquifer. The problem for a driller is finding the exact position of the target well so that advanced kill techniques may be employed to halt the contamination. To complicate matters, it is not always possible to place a source down the target well from the surface, because the top portion of the well may not be accessible.

It may also be important to keep a fixed distance from an adjacent target well. For example, FIG. 3 shows a well plan with a complicated herring-bone structure. As can be seen, maintaining a fixed distance from an adjacent well is required. FIG. 4 shows a highly complex well pattern in which it may be important to stay a specified distance away from certain wells while intersecting another well.

The industry has attempted to solve the problem of locating an existing well from a borehole being drilled by using electromagnetic waves. An electromagnetic source is placed in the well being drilled and the resistivity of the surrounding medium is detected. When the well being drilled is proximate to the old well, the conductive casing inserted in the old well indicates the presence of the old well. Ilowever, this technique has several drawbacks. First, it is limited to close range applications. In addition, this technique may have difficulty establishing exactly where on the target well the well being drilled is juxtaposed. Thus, instead of hitting the bottom of the target well, the sensed section of the target well may be several hundred feet from the target point. Finally, this prior art technique requires that a casing be present in the existing well. Ideally, the driller of the new well would like to know the exact relative location of a target in the existing well. Further, the further away that the target can be detected, the better. Preferably, no casing would be required in the existing well. By providing exact relative location information, an operator could drill with greater speed and certainty.

Therefore, a need exists for a long distance ranging device to find a target downhole. Preferably, this device could be implemented as part of an LWD system. Ideally, this device could also be used with a geo-steering system to automatically steer the bottomhole assembly to the existing well. Further, the ideal technique would not require a controlled source but could also determine the distance to and location of a noise or random source. It would not be dependent on a conductive member being present in a target well, but could find a signal source regardless of the presence of a casing. Preferably, the device would utilize a ranging technique that could detect multiple sources. It also could account for any underground refractions or reflections by the transmitted signal, thereby establishing the shortest drilling distance to the target.

SUMMARY OF THE INVENTION

The present invention solves the shortcomings and deficiencies of the prior art by implementing an LWD system for determining subterranean source position and contribution. In an exemplary embodiment, the distance and direction to the signal source determined by the LWD system then can be used by a downhole microprocessor to control the direction or inclination at which the well is drilled. Alternately, the source distance and direction can be transmitted via a mud pulse signal or other signal to the surface to provide real-time information to a driller.

In an exemplary embodiment, the LWD tool is used to determine location of an acoustic source. The preferred embodiment is capable of detecting and locating multiple sources while accounting for any underground refractions or reflections by the transmitted signals. In an exemplary embodiment, the LWD tool includes an array of sensors for receiving acoustic signals from a subterranean acoustic source. The signal may be from a controlled source such as a swept frequency source, or from a random source such as a drill bit engaged in drilling or from the influx of fluid into a well. The received signals are filtered to remove extraneous noise from the drilling process and to eliminate undesirable signals, such as the acoustic waves traveling through the logging tool itself. The signal is then converted to a high precision digital signal and provided to a digital signal processor. There, the preferred embodiment uses a holographic technique to determine source location and contribution. Alternately, a triangulation method may be employed to determine source location. The results may then be transmitted to a real time display to allow an operator to change drilling direction.

The holographic technique includes dividing the area surrounding the signal receiver into a number of volume cells and assigning an acoustic propagation velocity to each. A hypothetical source location is then selected. Since an acoustic signal changes direction according to Snell's law each time the propagation velocity changes, a ray trace is calculable between the source and receiver. A ray trace is derived for each receiver position and a comparison is made between the various receivers by transforming the received signal into the wave number domain. Source contribution is determined once the signal is in wave number domain. Reflectors are distinguished from true sources because, unlike true sources, reflectors appear as moving sources as the operator drills and changes the position of a receiver or receiver array.

An array of receivers may be located on the drill string or may be positioned on an adjustable stabilizer, if present. In one embodiment, the acoustic receivers comprise hydrophones positioned on opposite sides of a deployed drillstring, in a staggered configuration. In another embodiment, the acoustic receivers comprise geophones located in the blades of an adjustable stabilizer, preferably spaced around the periphery of the drillstring.

Thus, the present invention comprises a combination of features and advantages which enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

Figure 5:
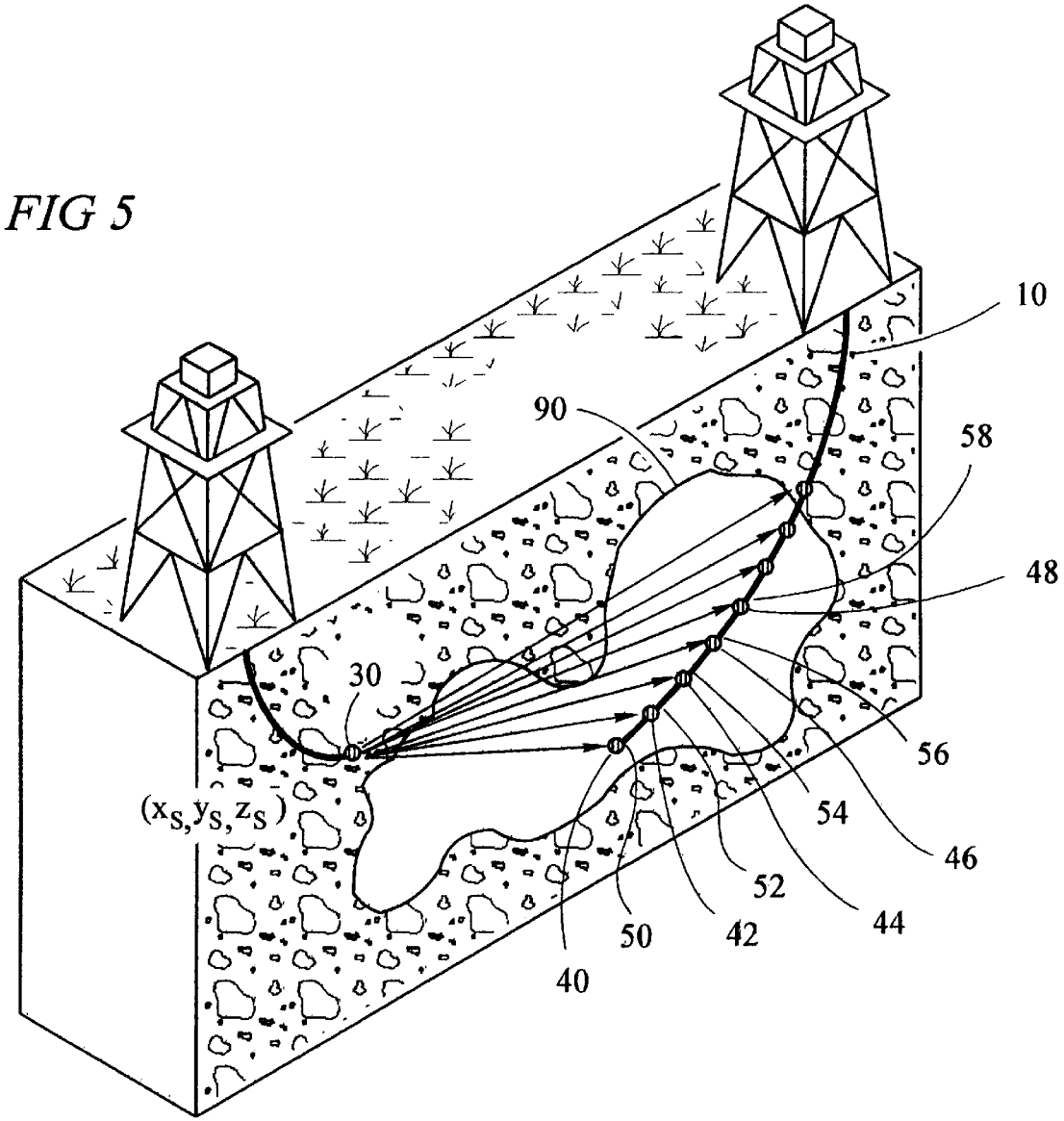
FIG. 5 is an isometric view of a target well and a well being drilled.

Referring now to FIG. 5, an active well 10 is shown with receivers 40, 42, 44, 46, 48 for locating a source 30 in a target well 20. In operation, source 30 emits a homing signal that is transmitted to the surrounding formation. At some distance away, receiver(s) 40, 42, 44, 46, 48 receive the homing signal and store a digital representation of the received signal. This digital data is analyzed by a processor either downhole or at the surface to determine distance and direction from the receiver(s) to the source.

The present invention requires a minimum of one receiver in the active well being drilled. Preferably, and as shown in FIG. 5, the drilling system includes multiple receivers, with approximately 8 receivers being a preferred number. The single receiver embodiment of the present invention requires that the operator of the bottomhole assembly take a reading, drill for some period of time to change the position of the receiver, and then take another reading. An array of receivers allows the operator of the bottomhole assembly to take multiple readings at a single point in time. A receiver array with a greater number of receivers allows more data to be collected with less measurement error. In a single receiver embodiment, locations 50, 52, 54, 56, 58 correspond to the multiple positions of the single receiver during drilling as the borehole assembly approaches source 30. Alternately, in a multiple receiver embodiment locations 50, 52, 54, 56, 58 may correspond to an array of n receivers 40, 42, 44, 46, 48 at a single point in time. As shown in FIG. 5, source 30 is located at position ($x_s$, $y_s$, $z_s$) while the n receivers are located at ($x_n$, $y_n$, $z_n$) respectively. Also shown in FIG. 5 are representative wave-form ray paths 90 to the n receivers.

In the preferred embodiment of the present invention, source 30 in target well 10 is preferably an acoustic transmitter. Although the source 30 may comprise an electromagnetic transmitter or some other type of energy source, the source 30 preferably comprises an acoustic transmitter because acoustic waves are capable of traveling long distances and are not limited by a medium's resistivity. As is known in the art, the maximum distance traveled by a wave-form is dependent upon the propagation characteristics of the medium through which it travels. In addition, low frequency acoustic waves travel further than high frequency acoustic waves in a wave-length proportional relationship. For example, a wave-form with a frequency of 500 Hertz may travel one-half mile, while a wave-form at a frequency of 100 Hertz may travel two and one-half miles. Another reason acoustic sources are preferred is that acoustic sources are capable of emitting multiple modes or phases of propagation. As is well known in the art, acoustic signals may generate two different wave types in a formation, commonly referred to as compressional waves and shear waves. Each wave type has its own amplitude, frequency, and velocity. Compressional waves (also known as P-waves, dilational waves, or pressure waves) are typically fast, low amplitude, longitudinal waves generated parallel to the direction of wave propagation. Shear waves (also known as S-waves, distortional waves, or rotational waves) are slower, typically moderate amplitude, transverse waves generated perpendicular to the direction of wave propagation. Since compression waves travel faster, normally the initial wave train received will be a compression wave. However, depending on the relative position of the source and sensor, and whether the source generates both types of waves, either a P-wave or an S-wave may arrive first at the receiver.

Figure 1:
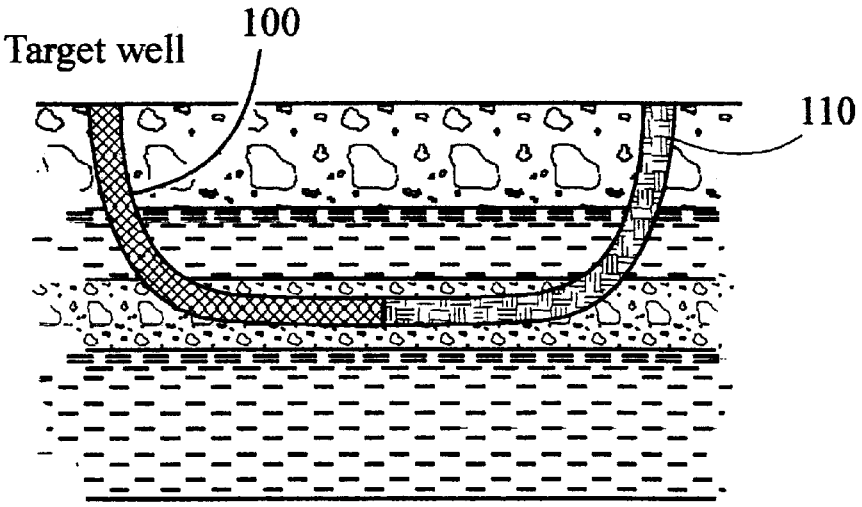
FIG. 1 is a diagram illustrating a heads-on intersection of two wells.
Figure 2:
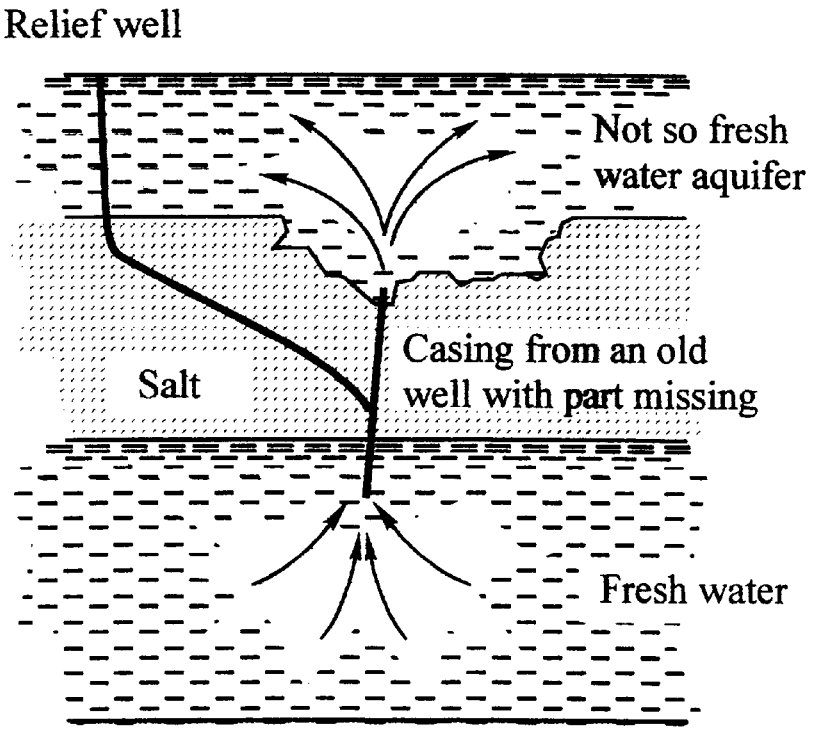
FIG. 2 is a cross-section view of a subterranean well blow-out causing water to leach salt into a fresh water aquifer.
Figure 3:
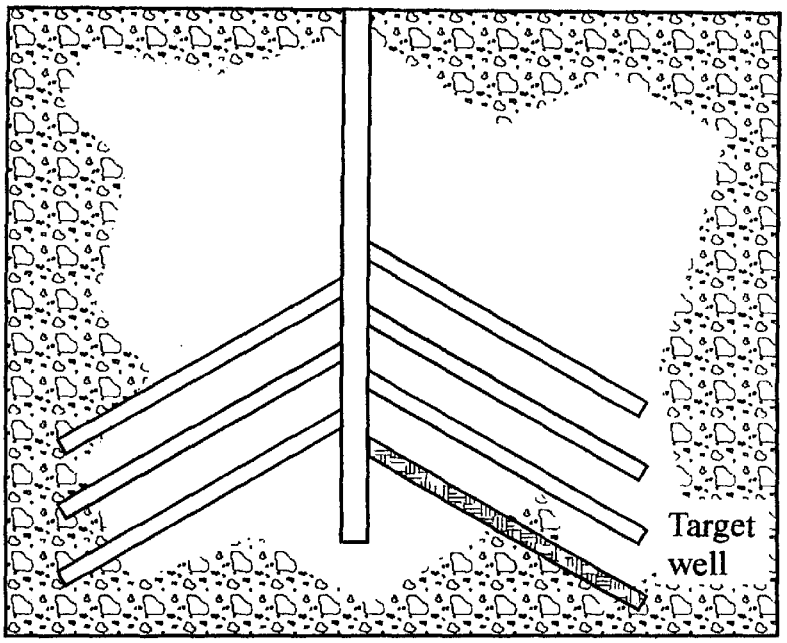
FIG. 3 is cross-section view of a complex well with herring bone structure.
Figure 4:
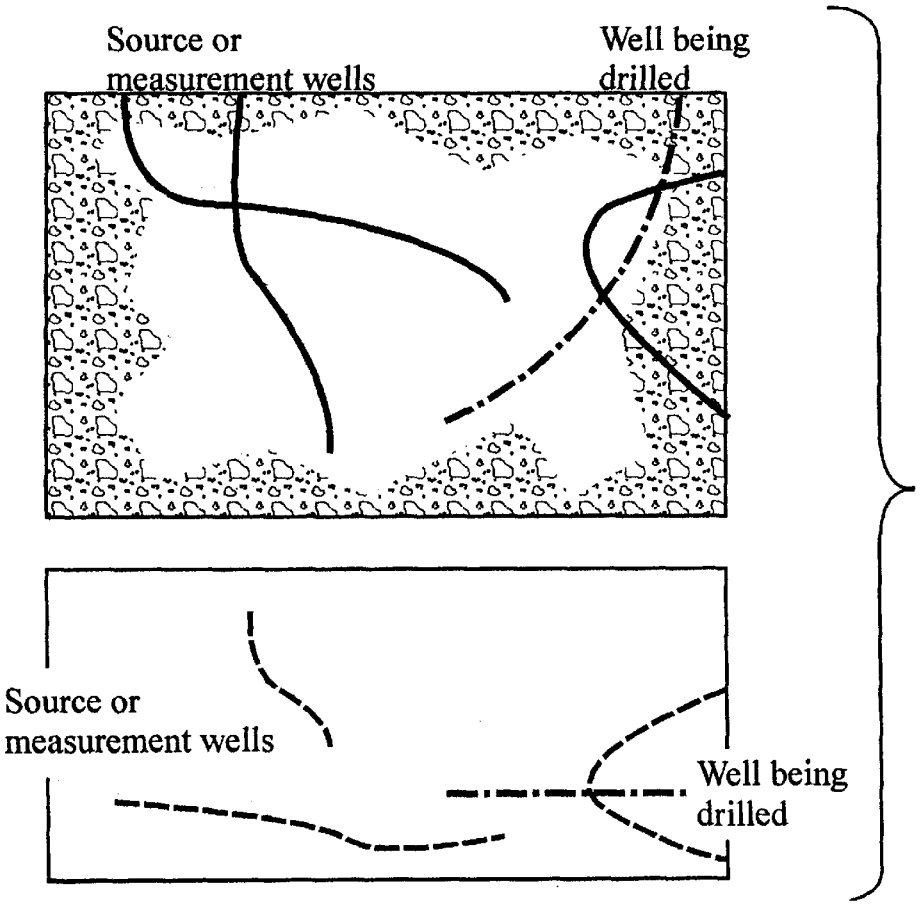
FIG. 4 is a sectional and top view of a highly complex well pattern with multiple well bores.
Figure 15A:
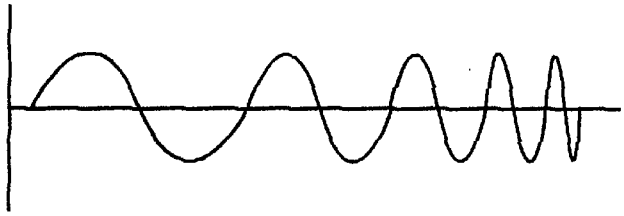
FIGS. 15A–B are exemplary waveforms generated by a controlled source.
Figure 15B:
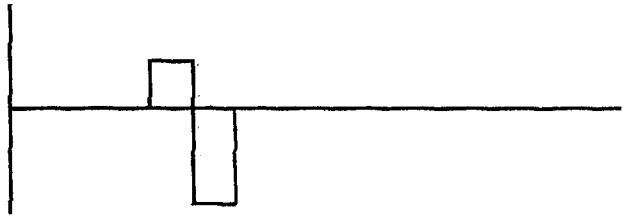

Acoustic source 30 also may be controlled or random. A controlled source emits a predictable waveform such as a swept frequency signal or a pulse signal. Suitable controlled source transmitters include piezo-electric or magnetostrictive devices. The swept frequency signal progresses through a range of frequencies as illustrated in FIG. 15A. The swept frequency signal maximizes the probability that a recognizable received signal will be obtained and recovered by the receiver because it typically is easier to correlate the transmitted and received signals if a swept frequency sign is transmitted. Alternately, a controlled source 30 may emit a pulse signal whose frequency is dependent on known formation properties and the estimated distance between the source and receiver(s). An exemplary pulse signal is illustrated in FIG. 15B. While the pulse signal is more difficult to identify than a swept frequency signal, it is still easier to identify and correlate at the receiver than a random signal. Examples of random sources include a target drill bit engaged in drilling or a blow-out in the casing through which fluid flows, as illustrated in FIG. 2.

Referring still to FIG. 5, the sensors 40, 42, 44, 46, 48 preferably comprise either hydrophones or geophones or some combination of the two. Sensors 40, 42, 44, 46, 48 may be part of a wire-line system, part of an LWD system, or part of a geo-steering system. Data collected during drilling may be sent immediately to the surface for processing, saved for later transmission or recovered at the surface when the sensor assembly is brought to the surface. Alternately, data collected by receivers 40, 42, 44, 46, 48 may be processed down hole.

Figure 6:
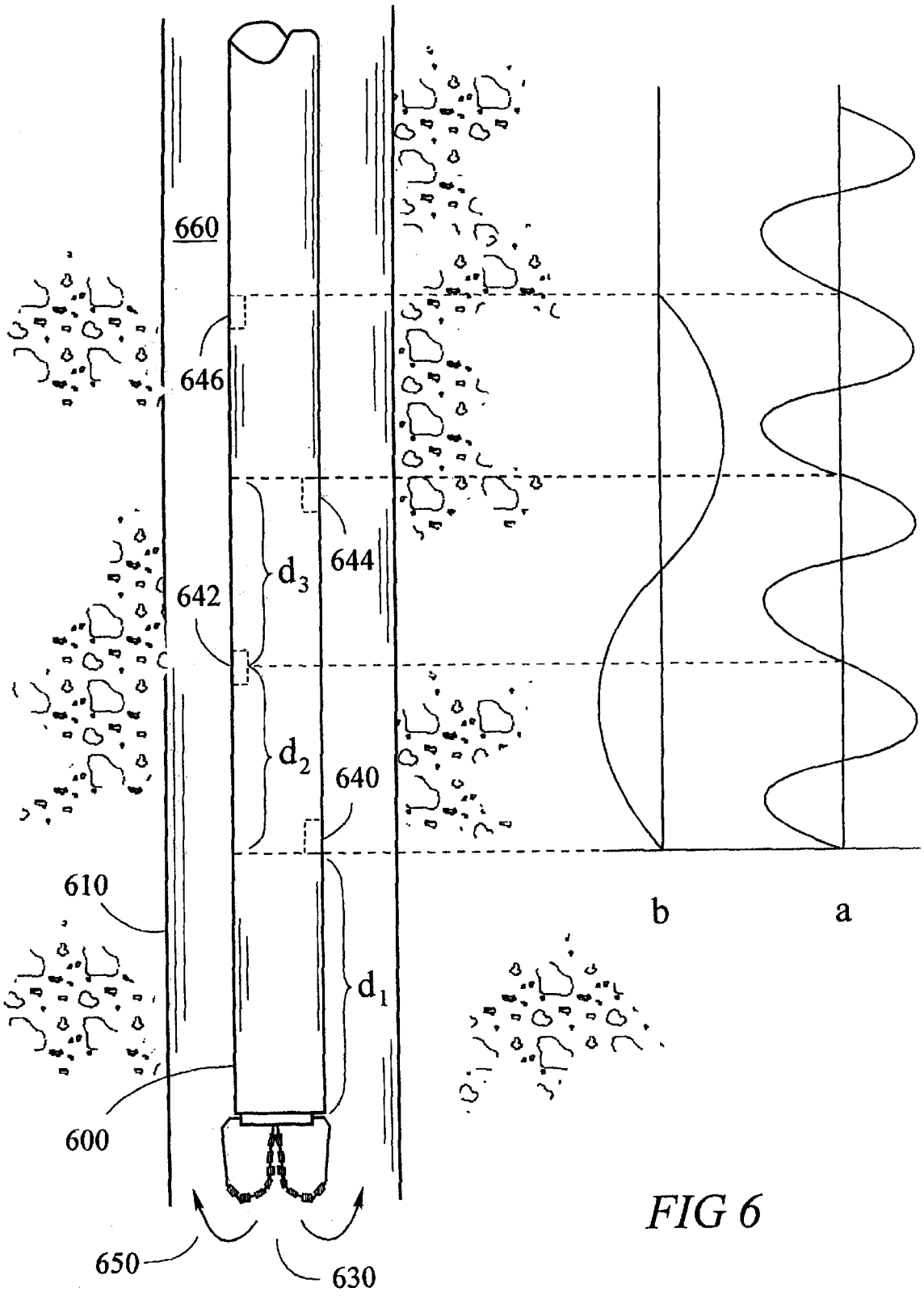
FIG. 6 is a side view of an LWD tool depicting even spacing of hydrophones along the drill string in accordance with another exemplary (or alternative) embodiment of the invention.

Referring now to FIG. 6, a section of drill collars in a drill string 600 is shown in a borehole 610. Displaced along drill string 600 are hydrophones 640, 642, 644, 646. Hydrophones 640, 642, 644, 646 are shown in a staggered configuration on opposite sides of drill string 600, although one skilled in the art will understand that the hydrophones may be axially aligned. In operation, drill string 600 is deployed in borehole 610, while drill bit 630 is used to drill additional sections of well 610. Drilling mud 650 is pumped from the surface and through drill bit 630 via drill string 600. Drilling mud 650 (represented by arrows) then travels up annulus 660 to the surface to be recycled and sent downhole again. The drilling mud acts as a cooling lubricant and carries drill bit cuttings away from the drill bit 630. The drilling mud may also act as a communication medium to transmit signals from the bottomhole assembly to the surface. As is well known in the art, by altering the flow of the drilling mud through the interior of the drillstring, pressure pulses may be generated, in the form of acoustic signals, in the column of drilling fluid. By selectively varying the pressure pulses, encoded binary pressure pulse signals can be generated to carry information indicative of downhole parameters to the surface for analysis.

Hydrophones 640, 642, 644, 646 are advantageously located along the drill string with a predetermined spacing. Thus, hydrophone 640 is positioned a constant distance $d_1$ from the drill bit 630, hydrophone 642 is displaced a distance $d_2$ from hydrophone 640, hydrophone 644 is a vertical distance $d_3$ from hydrophone 642. This sequence continues until all the hydrophones are located on the drill bit. Although FIG. 6 shows only four hydrophones, as explained above the preferred number of hydrophones is eight. The distance $d_1$ is preferably kept as small as possible (i.e., hydrophone 640 is placed close to the bit). As a result, the hydrophone 640 detects source emissions at the earliest possible time, thereby permitting course corrections as soon as possible. In contrast, distances $d_2$, $d_3$, are established based on two competing considerations. On the one hand, the spacing between the receivers should ideally be equal to one wave length. On the other hand, as the receiver travels towards the signal source, a higher frequency signal is preferred because resolution improves as frequency increases. This means that the acoustic frequency of the source preferably increases as the receiver array gets closer to the source.

In the preferred embodiment and referring to FIG. 6, the receiver assembly is configured assuming that the signal source in the target well will emit signals at a low frequency $f_{low}$ and at a high frequency $f_{high}$. Preferably, the high frequency is chosen as a multiple of the low frequency signal ($f_{high}$=K $f_{low}$) so that the wave length of the low frequency signal $\Sigma_{low}$ is a multiple of the wave length of the high frequency signal $\Sigma_{high}$ ($\Sigma_{low}$=K $\Sigma_{high}$). The receiver assembly is then selected with each receiver spaced apart an equal distance d corresponding to the wave length of the high frequency signal ($\Sigma_{high}$) so that d=$\Sigma_{high}$. In this manner, every K receiver will be spaced apart a distance equal to the wave length of the low frequency signal ($\Sigma_{low}$). Thus, if the high frequency signal is four times the frequency of the low frequency signal, then K=4. The wave lengths will similarly be multiples of each other, with the low frequency signal having a wave length $\Sigma_{low}$ four times as long as the high frequency signal ($\Sigma_{high}$). All receivers will be spaced a distance apart defined by $\Sigma_{high}$, and the first and fifth receivers will be spaced apart a distance equal to $\Sigma_{low}$. The low frequency signal is thus processed using receiver $R_1$ and $R_5$ (or $R_2$ and $R_6$, $R_3$ and $R_7$, . . . ), while high frequency signals are processed with all the receivers.

Figure 7:
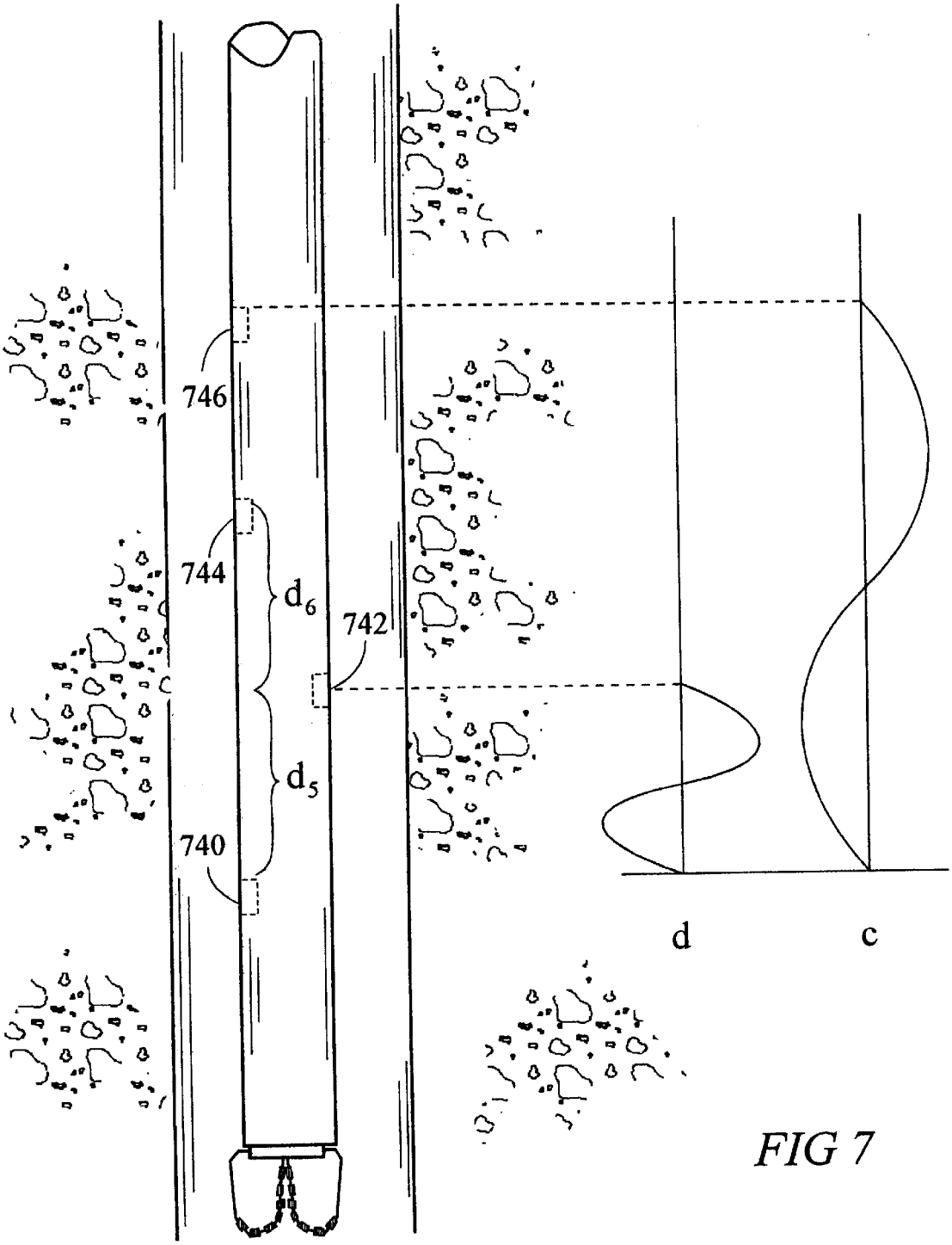
FIG. 7 is a side view of an LWD tool depicting uneven spacing of hydrophones along the drill string in accordance with another exemplary (or alternative) embodiment of the invention.

FIG. 7 illustrates another alternative spacing. Once again, fewer receivers than the preferred eight are shown. This alternative spacing places the receivers at different distances from one another so that $d_5$ does not equal $d_6$. In this alternative embodiment, the receiver nearest the drill bit would always be used, but as the frequency of the source increases, different receivers are ideally used. Referring to FIG. 7, at low frequency c receivers 740 and 746 are spaced at one wavelength. At higher frequency d, receivers 740 and 742 are one wavelength apart. Thus, depending upon the source frequency, different receiver pairs are spaced at the ideal distance of one wavelength.

Figure 8:
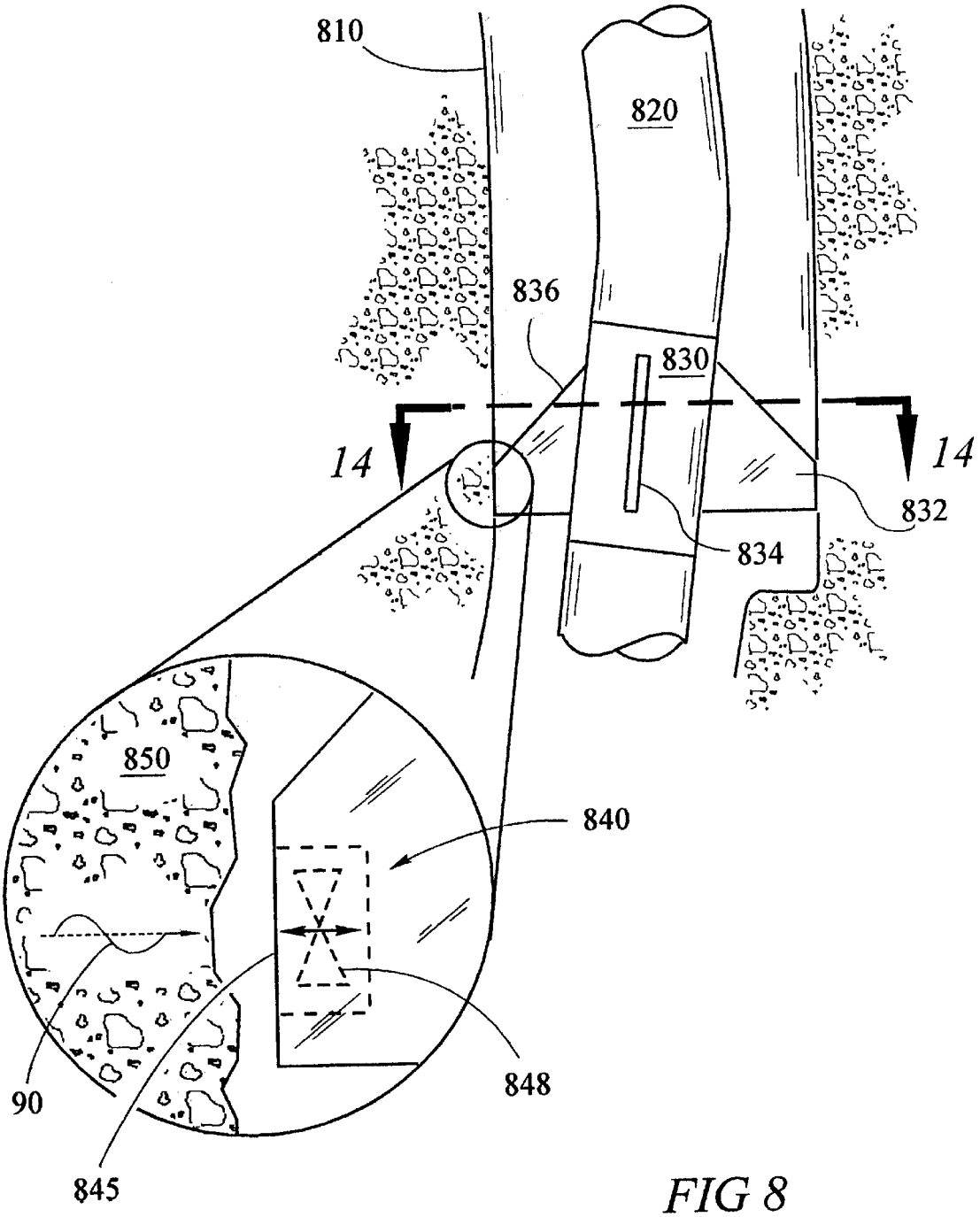
FIG. 8 is an illustration of a geo-steering system in which geophones are mounted on adjustable blade stabilizers.

FIG. 8 illustrates the use of geophone sensors in a geo-steering system that uses adjustable stabilizers as disclosed in commonly assigned U.S. Pat. No. 5,332,048, the teachings of which are incorporated herein by reference. Wellbore 810 contains a section of drillstring 820. Adjustable stabilizer 830 preferably includes blades 832, 834, 836 which serve to change the angular direction of drillstring 820 in the wellbore 810 as described in U.S. Pat. No. 5,332,048. Contained within each blade is a geophone 840, which detects acoustic signals 90 from an acoustic source 30 (FIG. 5). Geophone 840 is preferably enclosed in a protective case that protects transducer 848 from the wellbore 810 but permits incoming acoustic signals 90 to be received by the transducer 848. Acoustic signal 90 travels from acoustic source 30 through the surrounding formation 850, through protective material 845 and to transducer 848. Transducer 848 then vibrates in response to the received acoustic signal, and generates an electrical signal.

Figure 14:
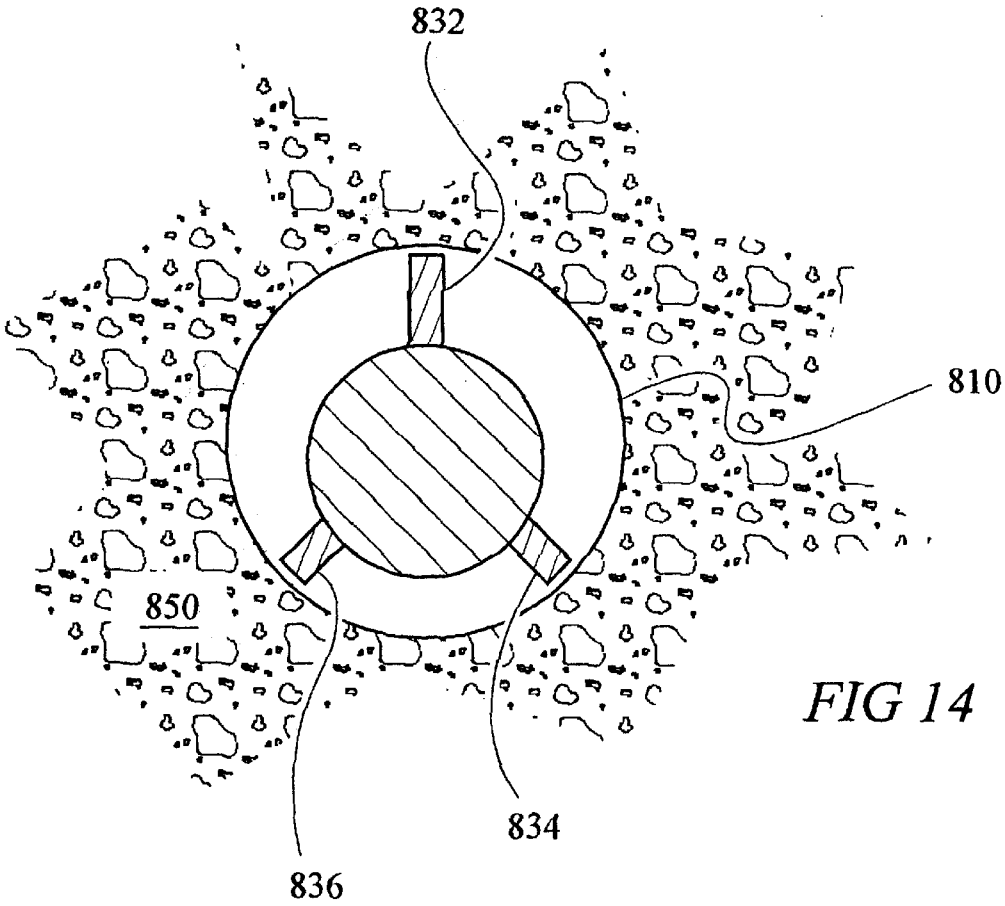
FIG. 14 is a top perspective view of a geo-steering stabilizer.

Geophones are in certain respects preferable to hydrophones because of their three-dimensional sensing capabilities. However, if geophones are chosen as the receivers downhole they are preferably flush against the wall of the wellbore formation and should be spaced around the periphery of the wellbore. FIG. 14 shows a top view of stabilizer 830 taken along lines 14—14 in FIG. 8 within wellbore 810. Each blade 832, 834, 386 includes a geophone 840 (not shown).

While geophones may be used as sensors outside the context of a geo-steering system, the blades of an adjustable stabilizer 830 are an appropriate place to mount a geophone since the blades 832–836 typically are in close proximity to the wall of the wellbore. In one envisioned embodiment, data collected by geophone 840 is sent to the surface and processed to determine the characteristics of the surrounding formation and the location of an acoustic source. An operator then uses the data to control the steering system. Alternately, the data could be processed downhole and used in a closed-loop steering system wherein the drill bit automatically drills towards a target.

Figure 10A:
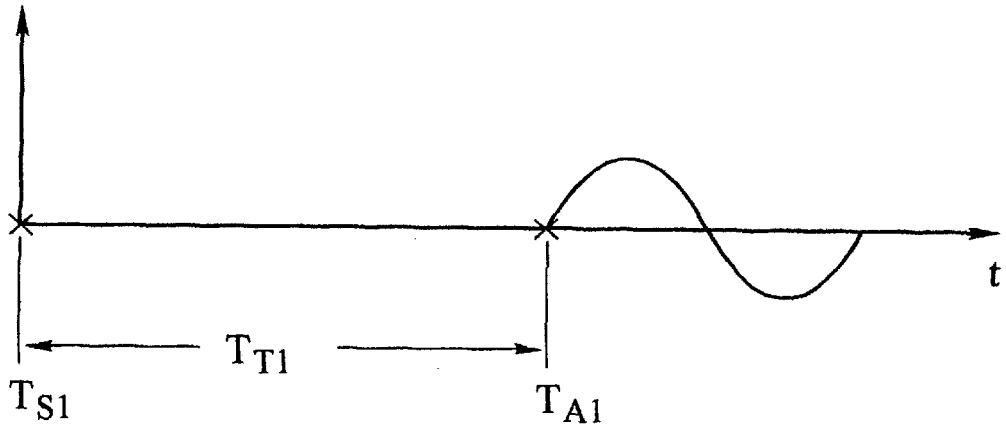
FIGS. 10A–10C are timing diagrams for a single receiver illustrating the start times and arrival times of acoustic signals.
Figure 10B:
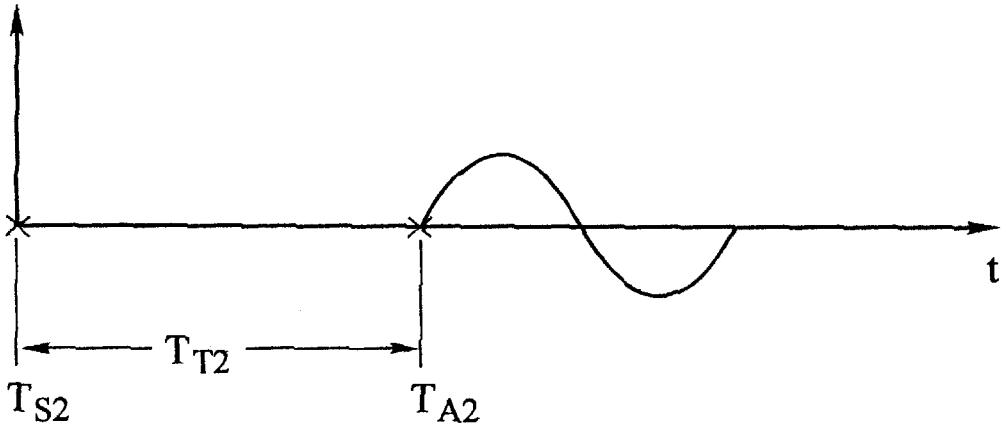
Figure 10C:
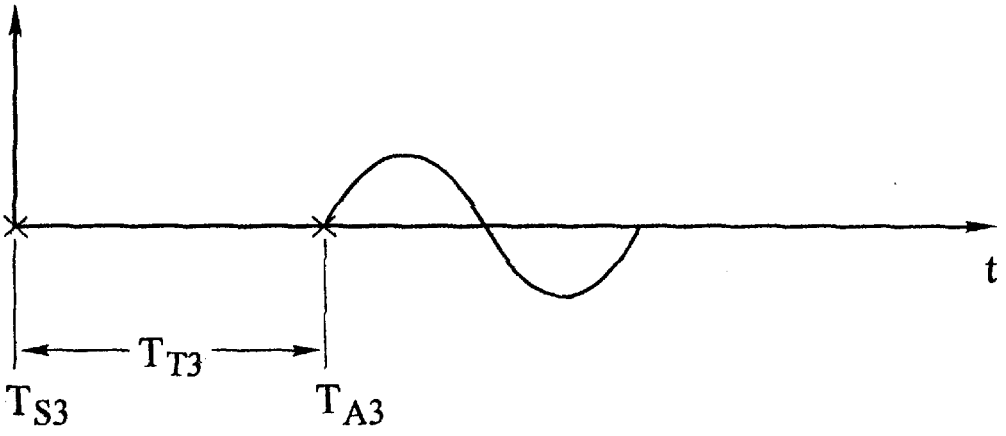

Referring now to FIGS. 10A–10C, the single receiver embodiment described above requires subterranean readings that are displaced in time. FIGS. 10A–10C illustrate an idealized received wave pulse at a single receiver at three different points in time. When using a single receiver, start times, $T_{S1,\ TS2}$, etc., and arrival times, $T_{A1}$, $T_{A2}$, etc., must be known so as to establish the travel time, $T_{T1}$, $T_{T2}$, etc. of each wave train between the source and the receiver. Shown in FIG. 10A is the start time of a first wave train, $T_{S1}$, and its subsequent arrival time, $T_{A1}$. As is obvious from reference to FIG. 10A, the start time must be known to calculate the travel time, $T_{T1}$. Accurate determination and synchronization of the start and arrival times complicates the single receiver embodiment.

Figure 11:
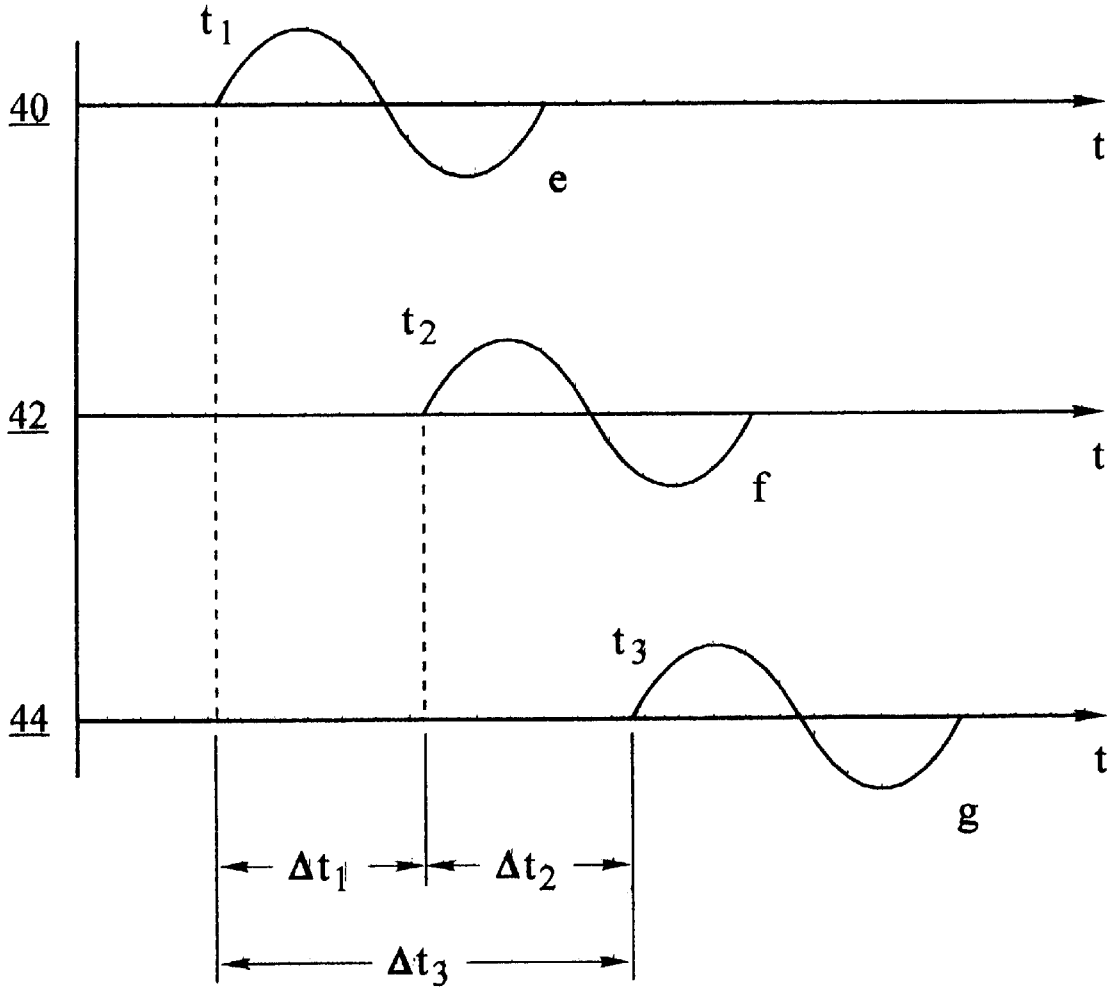
FIG. 11 is a timing diagram for an array of receivers illustrating the difference in arrival times.

In contrast, by utilizing multiple receivers, identification of the start time is not required. FIG. 11 is a graph depicting the arrival times at consecutive receivers along the drill string of an ideal waveform. Acoustic signal C arrives at sensor 40 at some time $t_1$. Acoustic signal f then arrives slightly later at sensor 42 at time $t_2$. Sensor 44 detects signal g at time $t_3$. Instead of using travel time, $T_T$, as explained with regard to a single receiver, multiple receivers allow the use of the difference in arrival times $\Delta t$ at an earlier receiver and a later receiver (e.g. $\Delta t_1$, $\Delta t_2$, $\Delta t_3$) to find source location.

The use of multiple receivers also improves the performance of the present invention because of coherency. Each receiver of a multiple receiver array receives the same wave-form (at slightly different times) so it is easier to correlate the waves. As is readily appreciated by one of ordinary skill in the art, this becomes important in the presence of noise.

Not shown in FIGS. 10 or 11 is the random noise that affects the appearance of each received signal. Random noise complicates identification of the received waveforms and creates a lack of coherency between received signals in the single receiver embodiment. To reduce interference from extraneous noise, the operator may halt drilling at the receiving wellbore while measurements are being taken. Further, additional receivers may be added since an increased number of sensors makes it easier to filter out extraneous noise. When a drill bit is being used as the acoustic signal source, identification of its signal at a receiver in a separate wellbore is simplified by recording the bit signal at the surface or transmitting the waveform of the random source signal to the surface. There, it is compared with the signal received at the acoustic receiver.

Figure 9:
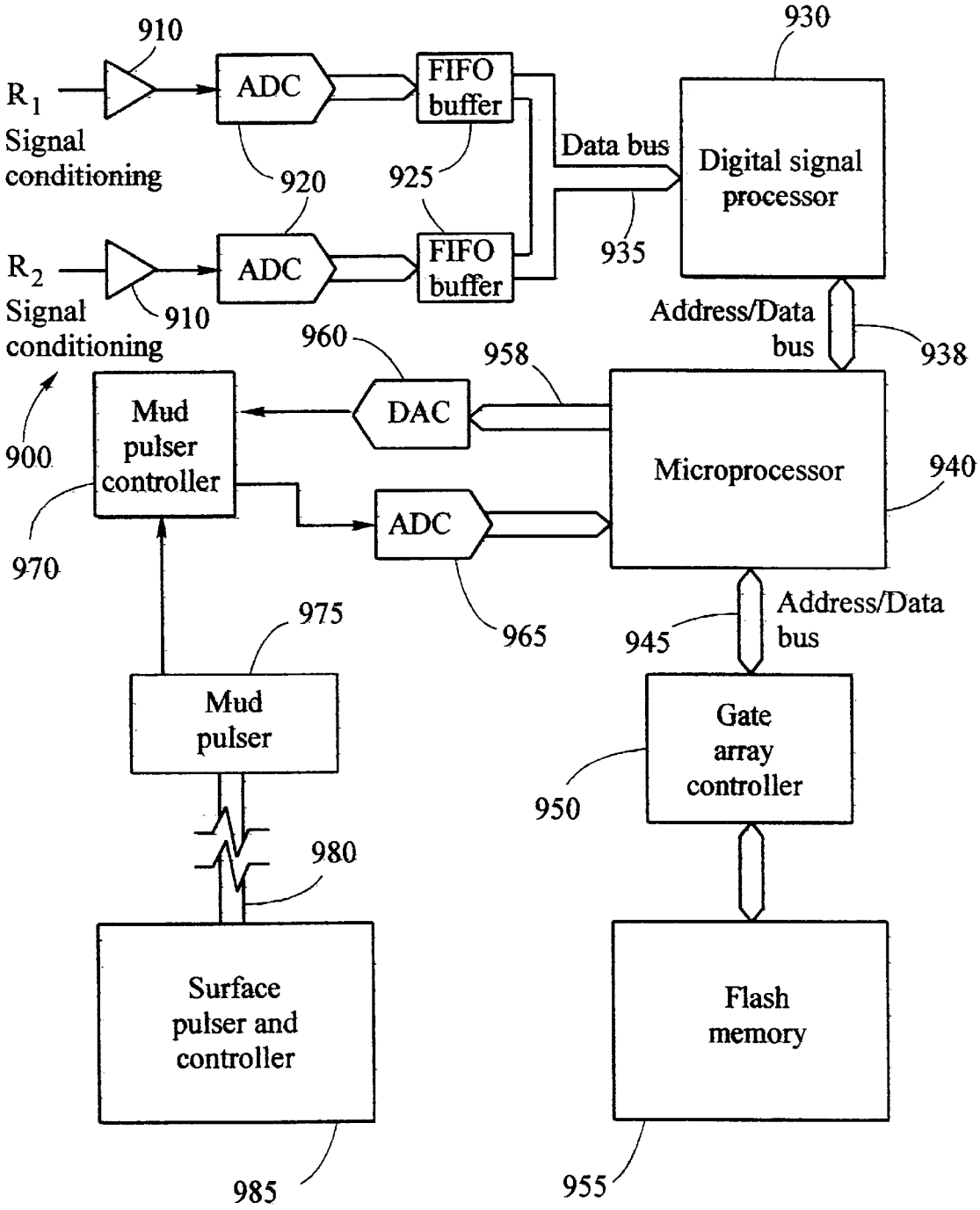
FIG. 9 is a schematic diagram of an electrical data processing circuit suitable for a preferred embodiment of the present invention.

Regardless, as one skilled in the art will realize, incoming signals must be smoothed and filtered to eliminate noise. The circuitry used in the preferred embodiment to generate the transmitted signals and to smooth and process the received signals is shown in FIG. 9. Referring now to FIG. 9, the electronics for the preferred embodiment includes receivers (only two are shown in FIG. 9 as $R_1$, $R_2$ to simplify the drawing), signal conditioning and processing circuitry 910, a digital signal processor (or DSP) 930, a downhole microprocessor (or microcontroller) 940, a downhole memory device 955, and a mud pulser controller 975.

In the preferred embodiment, where multiple receivers are implemented, multiple signal paths are required to the DSP 930. If additional receivers are used, additional paths must be provided. Receivers $R_1$ and $R_2$ receive acoustic signals from the formation and in response produce an electrical analog signal. The electrical analog signals preferably are conditioned by appropriate signal conditioning circuitry 910. As one skilled in the art will understand, the signal conditioning circuitry may include impedance buffers, filters, gain control elements, or other suitable circuitry to properly condition the received analog signal for processing by other circuit components. In the preferred embodiment, the conditioning circuitry includes a filter for excluding lower frequency noise that is present during drilling.

The conditioned signal is applied to an analog-to-digital (A/D) converter 920 to convert the analog signal to a digital signal. To maintain an appropriate degree of accuracy, the A/D converter 920 preferably has a resolution of at least 12 bits. The digital output signal from the A/D converters 920 are applied to FIFO (first in, first out) buffers 925. The FIFO buffers 925 preferably function as a memory device to receive the asynchronous signals from the receivers, accumulate those signals, and transmit the signals to the digital signal processor 930 at a desired data rate to facilitate operation of the digital signal processor. The FIFO buffers 925 preferably have a capacity of at least 1 kbyte. The data from the FIFO buffers 925 is transmitted over a high speed parallel DMA port 935, which has a preferred width of at least 16 bits. Thus, the signal conditioning and processing circuitry 900 takes the analog signal from the receivers and produces a high precision digital signal representative of the received acoustic signal to the digital signal processor 930.

The digital signal processor (DSP) 930 preferably comprises a 32-bit floating point processor. As shown in FIG. 9, the DSP 930 receives the digitized representation of the received acoustic signals over the 16-bit data bus 935. The DSP 930 also connects to the microprocessor (or microcontroller) 940 via a multiplexed address/data bus 938. In accordance with the preferred embodiment of the present invention, the DSP 930 performs computations and processing of data signals and provides the results of these computations to the microprocessor 940.

The microprocessor 940 preferably comprises a full 16-bit processor, capable of withstanding the high temperature downhole. As noted above, the microprocessor 940 preferably connects to the digital signal processor 930 through a 16-bit multiplexed address/data bus 938. The microprocessor 946 also connects through a multiplexed address/data bus 945 to a memory array 955, which is controlled by a gate array controller 950. The microprocessor 940 preferably provides output signals to the mud pulser controller 970 on data bus 958 for transmission to the surface via mud pulse signals modulated on the column of drilling mud 980. The digital output signals on data bus 958 are provided to a digital-to-analog (D/A) converter 960, where the signals are converted to serial analog signals. In the preferred embodiment, the microprocessor 940 also receives signals from the mud pulser controller 970 through an analog-to-digital converter 965. In this manner, the microprocessor 940 also can receive operating instructions from a controller 985 at the surface.

While an exemplary embodiment has been shown and described for the electronic logging circuitry to implement a short acoustic pulse transmission, one skilled in the art will understand that the electronic circuitry could be designed in many other ways, without departing from the principles disclosed herein.

In the embodiment of FIG. 9, the downhole memory device 955 preferably comprises an array of flash memory units. In the preferred embodiment, each of the flash memory devices has a storage capacity of 4 Mbytes, and an array of 9 flash memory devices are provided to provide a total storage capacity of 36 Mbytes. More or less memory may be provided as required for the particular application. In the preferred embodiment, the DSP 930 and microcontroller 940 provide real-time analysis of the received acoustic wave to permit real-time decisions regarding the drilling operation. The entire digitized waveform, however, is stored in the downhole memory 955 for subsequent retrieval when the bottomhole drilling assembly is pulled from the well. Data is written to the memory 955 through a gate array controller 950 in accordance with conventional techniques.

The mud pulser unit 975 permits acoustic mud pulse signals to be transmitted through the column of drilling mud 980 to the surface controller 985 during the drilling of the wellbore. The mud pulser unit 975 preferably includes an associated controller 970 for receiving analog signals from the D/A converter 960 and actuating the mud pulser 975 in response. In addition, in the preferred embodiment, the mud pulser 975 includes a transducer for detecting mud pulses from the surface controller 985. The output of the transducer preferably connects to the controller 970, which decodes the signals and produces an output signal to the microprocessor 940 through analog-to-digital converter 965.

As explained above, the received wave train may be a compression wave, a shear wave, a compression wave followed by a shear wave, or a shear wave followed by a compression wave. Analysis of the received wave train uphole or by the DSP 930, such as by a semblance guided phase picking algorithm, is required to identify the major phase arrivals. Multiple phase arrivals indicate multiple sources, multiple modes from a single source, reflections from geological layers, or some combination of these. Mis-identification of the type of wave received causes a poor prediction of source location. However, compression and shear waves are closely related by rock properties, so the arrival delay between the compression and shear wave is computable and predictable for a given source. If the time delay between two received signal wave trains at the receiver corresponds to the predicted time delay between different modes, then it is likely that two modes from one source are being received at the receiver. Additional readings or receivers in the array would help substantiate or undermine this conclusion.

The specifics of the triangulation technique and the holographic technique used to determine source location will now be addressed. The techniques may be used either singly or combination.

Triangulation Technique

Figure 12:
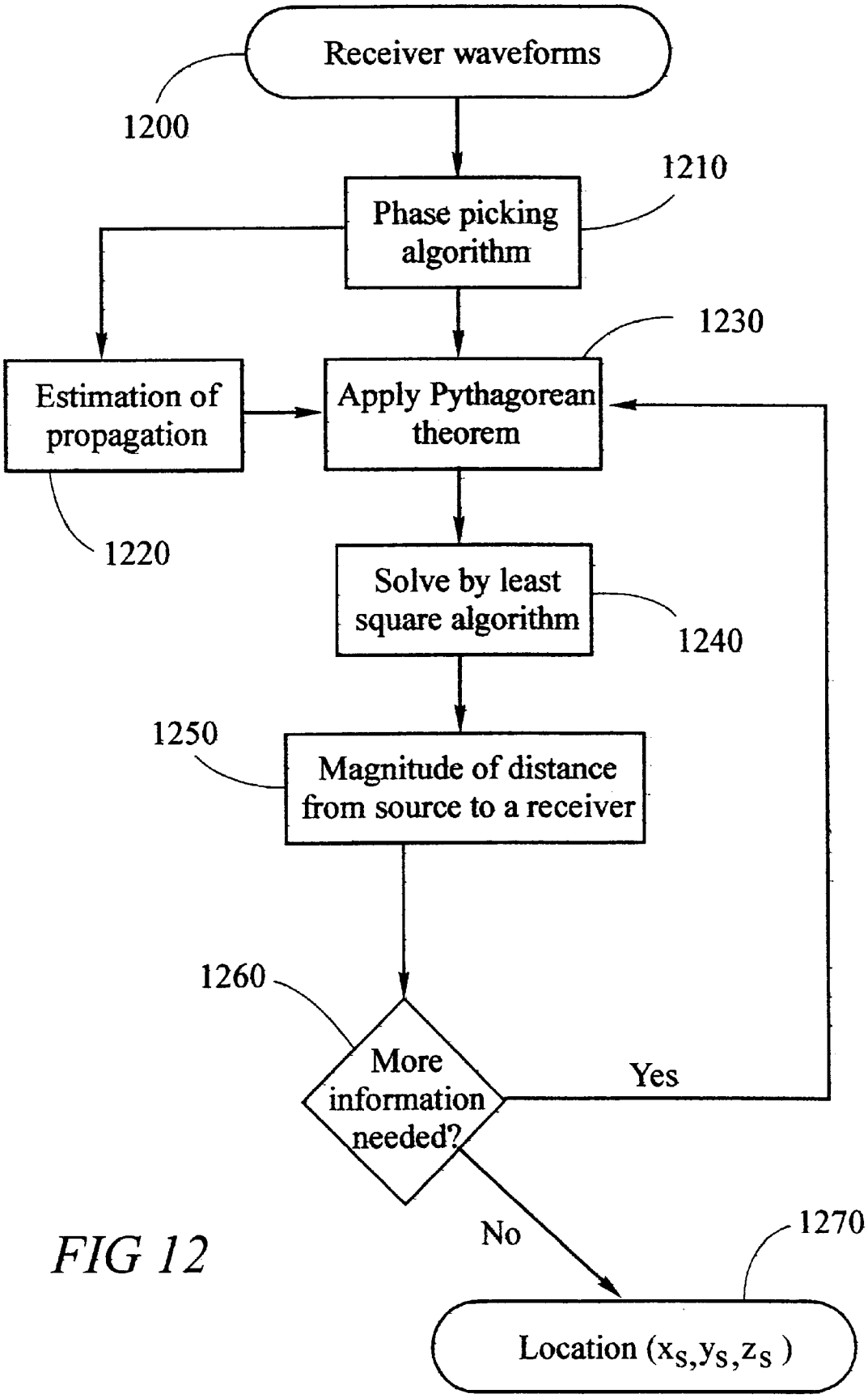
FIG. 12 is a flow diagram depicting a triangulation technique for determining the location of a target well.
Figure 16:
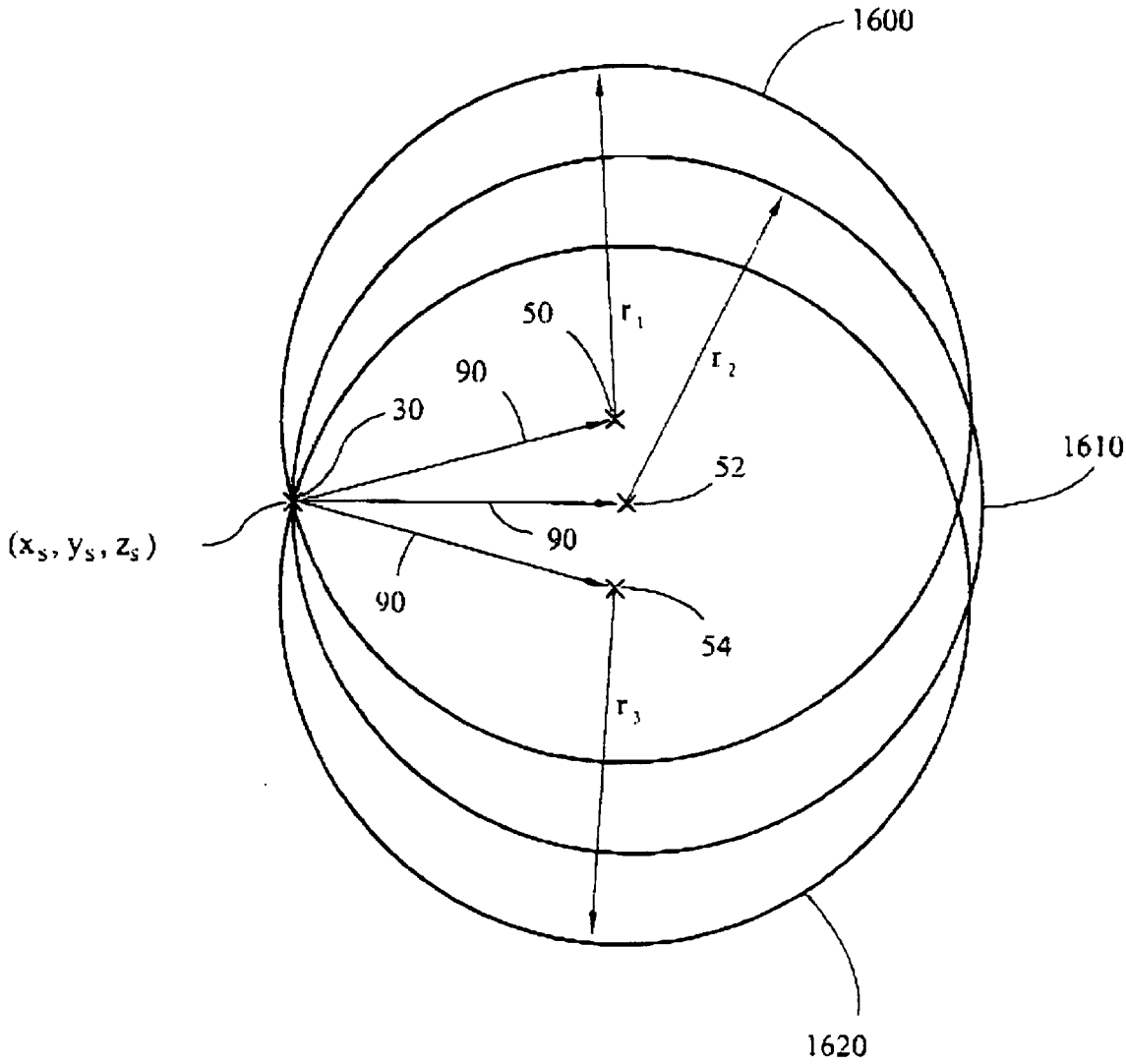
FIG. 16 is an illustration of finding a source location using the triangulation technique.

Generally, the triangulation technique determines the position of a source by the use of three different readings and the Pythagorean theorem. As can be seen by reference to FIG. 12, waveforms are received in step 1200 and are correlated by a phase-picking algorithm in step 1210 as is well known in the art. Initial band pass filtering may be used to enhance signal quality. Next, an estimated propagation velocity at step 1220 is applied to the Pythagorean theorem at step 1230. Solving the equations by the least-square algorithm at step 1240 yields the magnitude of the distance from a receiver 40 to the source 30. As can be readily appreciated, modeling the single distance determined at step 1250 establishes a spherical surface on which the source may be located. Application of the Pythagorean theorem at step 1230 to a different receiver 42. or the same receiver 40 at a different position, yields another spherical surface on which the source must be located. The intersection of these two spheres creates a circle at any point along which the signal source may be located. Analysis of a third receiver or a third position for a receiver at step 1230 creates a third sphere on which the source may be located and thereby narrows the location of the signal source to a single point. Thus, source location ($x_s$, $y_s$, $z_s$) is derived as the point of intersection at step 1270. Source location ambiguity is reduced when the receivers are head-on or in an end-fire configuration with regard to the acoustic source. FIG. 16 illustrates this modeling, although the modeled geometric shape is a circle and not a sphere, since FIG. 16 is only two dimensional. The acoustic wave 90 received at position 50 by a receiver provides information regarding distance $r_1$ to source 30. This distance $r_1$ is modeled as circle 1600. Likewise, the acoustic wave 90 received at position 52 by a receiver provides information regarding distance $r_2$ to source 30. This distance $r_2$ is modeled as circle 1610. This sequence also models distance $r_3$ to yield circle 1620. The intersection of these three circles pinpoints the one location in space corresponding to source position 30.

Specifically, let a source position in Cartesian coordinates be ($x_s$, $y_s$, $z_s$) with the n-th receiver location of an array of receivers in the observation hole being ($x_n$, $y_n$, $z_n$). A Pythagorean relation between the source and the n-th receiver will be $$(x_n-x_s)^2+(y_n-y_x)^2+(z_n-z_s)^2=V^2(t_n-t_s)^2 \tag{1}$$

where ($t_n$–$t_s$) is the travel time for the average propagation of velocity (V) between the source and the receiver and distance on the right side of the equation is established by the relation distance equals velocity times time. For a propagation velocity (V), the successive receiver pairs (n-th to k-th) yield linear equations, $$(x_{n+k}+x_n)x_s+(y_{n+k}+y_n)y_s+(z_{n+k}+z_n)z_s-V^2(t_{n+k}+t_n)t_s=\frac{1}{2}(V^2(t_n^2-t_{n+k}^2)+(x_{n+k}^2-x_n^2)+(y_{n+k}^2-y_n^2)+(z_{n+k}^2-z_n^2)) \tag{2}$$

where n does not equal k. Equation (2) has five unknown values ($x_s$, $y_s$, $z_s$, $t_s$, V) with n!/2!(n–2)! possible receiver pair combinations. Here, $t_s$ (source origin time) or V (average velocity of signal to receiver) could be assumed or estimated to determine the remaining four unknown parameters. Often, an estimate of V is known from previous seismic exploration velocities or acoustic well logs. Alternately, well known measurement techniques can be used to establish an approximate average propagation velocity. Velocity may also be inferred from a greater number of measurements. Linear equation (2) is then solved by the least-square method. Various constraints of least square algorithms need to be considered to achieve the final goal. An iterative process could be employed to refine the initial assumed velocity.

Three measurements are not required if other information is known. The Pythagorean theorem merely requires a distance primer. The known variables may be the travel time of the wave between the source and the receiver and the approximate acoustic velocity, or the difference in arrival times of the compression wave in each of the receivers and the approximate propagation speed, or the difference in time between the arrival of the compression wave and the shear wave and the propagation velocity of each. Nonetheless, the greater the number of receivers the more precisely the location of the source may be defined.

Holographic Technique

Although the triangulation technique described above is useful, it uses average propagation velocity and assumes a straight line travel path for the acoustic wave from the source to the receiver. In reality, there may be refraction, reflection, and a known velocity structure. As is well known in the art, an acoustic wave travels through different media at different speeds, and is refracted to a new direction according to Snell's law at each boundary where propagation velocity changes. The velocity structure of the formation between the source and the well being drilled dictates the route taken by an acoustic waveform. Thus, the shortest acoustic path between any two points may not be a geometric straight line. Once the velocity structure is known, the shortest acoustic path between any two points may readily be found by variational calculus.

The holographic technique is a computation-intensive solution for finding source location which yields both source position and source strength. The holographic technique uses a known velocity structure to back-project and find various candidates for source location. Each receiver or receiver position therefore has its own map of source location candidates. Where source location candidates overlap between maps, a source has been found. By this method, more than one source position and their relative strengths can be determined from observations from a single array. To establish the position of multiple sources, multiple receivers are required.

Figure 13:
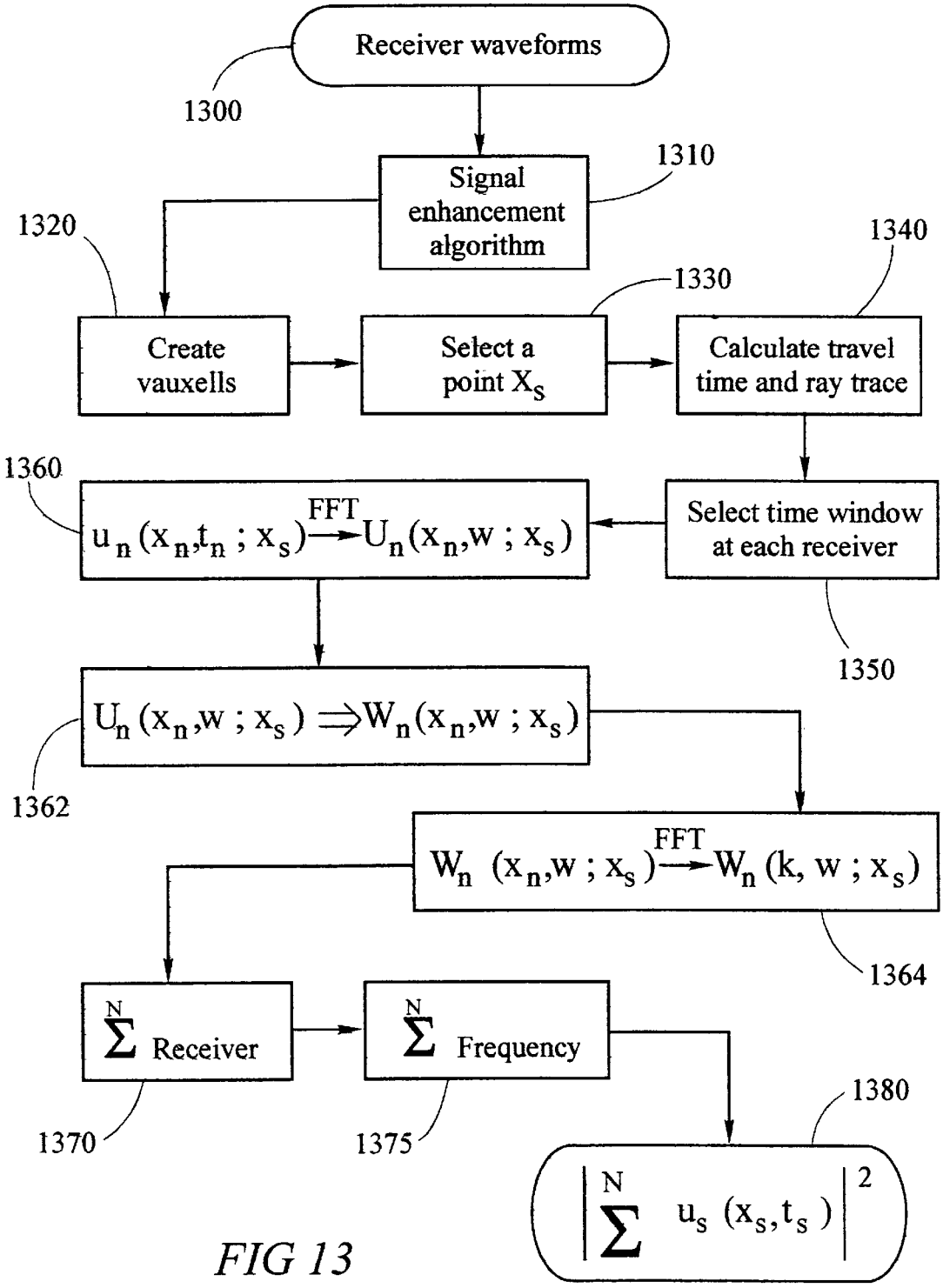
FIG. 13 is a flow diagram depicting a holographic technique for determining the location of a target well.

Referring to FIG. 13, a signal enhancement algorithm at step 1310 including filtering and coherence noise reduction is first applied to the received signal at step 1300 as is well known in the art. Then, hypothetical source positions are found by back-projecting through a known velocity structure. Back-projecting consists of first dividing the area surrounding the receiver array into a number of three-dimensional cells known as voxells at step 1320 based on a known velocity structure. For instance, referring to FIG. 17, each block 1700 is a voxell cell. Although the voxells 1700 appear to have equal volumes, in reality this is unlikely. Instead, it is the known velocity structure that determines the volume of each voxell 1700.

Figure 17:
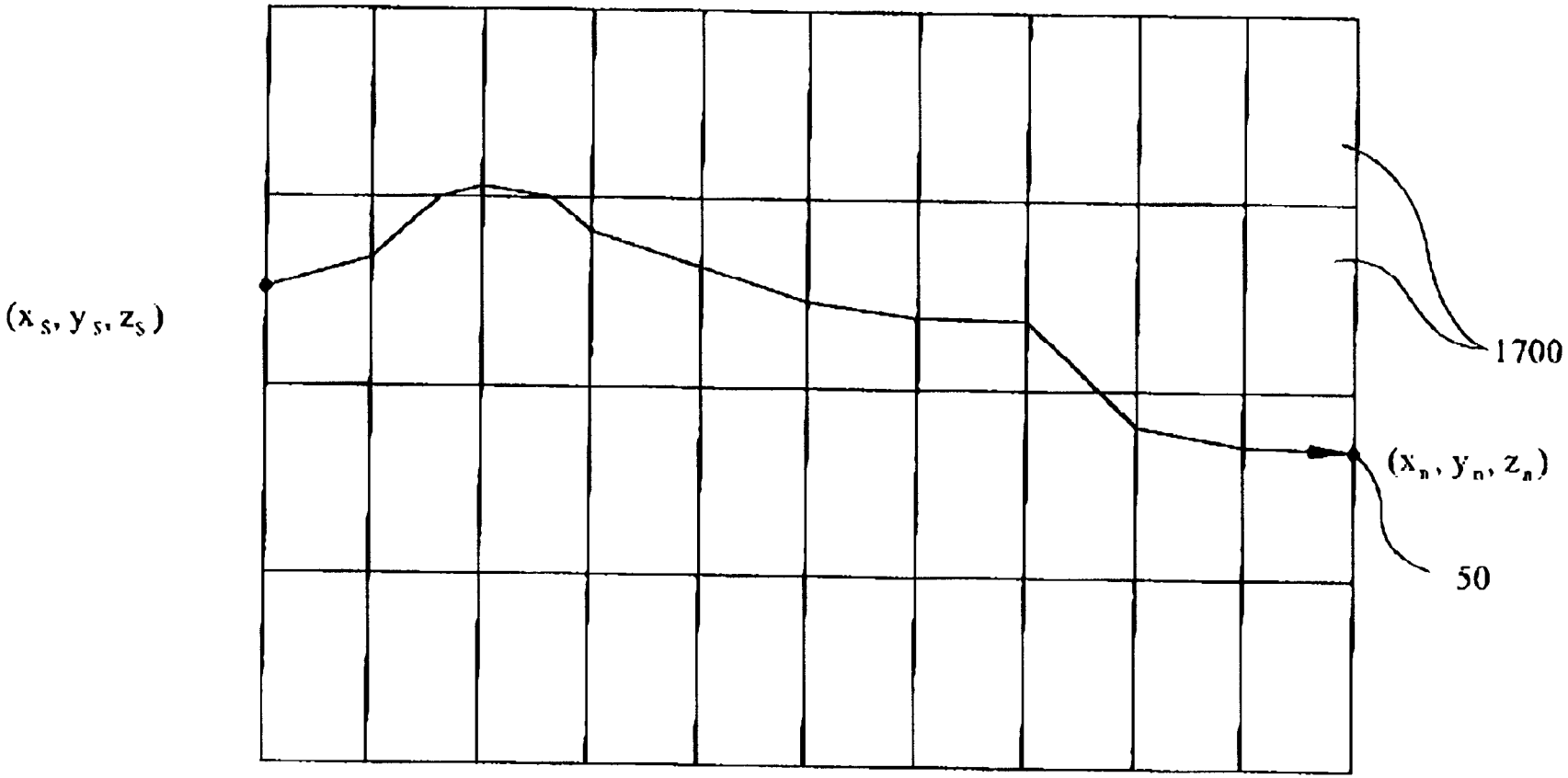
FIG. 17 is an illustration of a ray trace from a hypothetical source to a receiver position.

Then, each voxell is assigned a propagation velocity corresponding to the known velocity structure. In the event no velocity structure is known, the average propagation wave velocity can be approximated from the difference in signal reception time between the receiver pairs ($\Delta t$). Voxells need not necessarily even have different assigned propagation velocities. The same velocity may be assigned to each voxell. A location is then chosen as a possible acoustic source position at step 1330 in FIG. 13. All possible ray traces (i.e. the path an acoustic wave follows), are calculated and the ray trace with the shortest travel time is selected through variational calculus at step 1340 based on the assigned voxell velocities and Snell's law. FIG. 17 shows one possible ray trace 1710 from a source 30 to a receiver position 50. Alternately, back-projecting may begin at the sensor location and model a ray trace backwards to a source location.

Each candidate for source location has a start time calculated from the acoustic wave's propagation velocity and the acoustic distance from the receiver. For example, the start time may be derived from the known relationships:

$$T(x_n, x_s) = \frac{\text{distance}}{\text{velocity}} \tag{3}$$

$$T_s = T_n - \text{travel time} \tag{4}$$

where, $T_s$=the waveform start time; and $T_n$=the waveform arrival time at the applicable receiver.

$T(x_n, x_s)$=travel time of the signal between source and the applicable receiver.

A time window centered on the travel time from an assigned vauxel is then selected for each receiver at 1350. That is, a calculated travel time between the assigned vauxel as the hypothetical source and receiver is known. Therefore, surrounding each receiver is a space-time map of possible source locations and start times for a received wave-form. A common reference point in time is required to make meaningful the comparison of the maps of possible source locations and start times. To give each receiver a common reference point in time, a common time window should be used, thereby providing the magnitude of each $\Delta t$. Where source locations and start times coincide or intersect among all the maps, source location(s) and start time(s) have been found.

To mathematically execute the comparison between the maps, the response at each receiver is transformed into the wave number domain at 1360–64. The results are then summed over all the receivers 1370 and summed over all the frequencies 1375. This provides source location. The square of the magnitude of the time domain function 1380 representing each source yields the instantaneous power delivered by the source (i.e. the strength of the source) at the receiver location. The step of transforming the received response to the wave number domain should be explained. The three component responses at a receiver $x_n$ ($x_n$, $y_n$, $z_n$) recorded from a source at $x_s$ ($x_s$, $y_s$, $z_s$) which originates at time $t_s$ (start time) for a particular wave type can be represented as $$u_n(x_n, t_n; x_s, t_s) = \frac{1}{\Pi(x_n, x_s)} \frac{1}{\mathcal{R}(x_n, x_s)} \mathcal{F}(\theta, \varphi) u_s(x_s, t_n - t_s - T(x_n, x_s)) \tag{5}$$

where $u_n$=responses at the receiver $x_n$, $u_s$=source displacement at $x_s$, $\Pi$=transmission term between source and receiver, $\mathfrak{R}$=geometric spreading and $\mathfrak{I}$=source radiation pattern in polar coordinate ($\theta$, $\phi$).

For an elastic medium, the parameters are:

$$\Pi(x_n, x_s) = \sqrt{\rho(x)V(x)} \quad \Psi(x) \text{ is density and } V(x) \text{ is velocity}$$

$$\mathcal{R}(x_n, x_s) = \frac{\partial J(x_r, \Omega)}{\partial J(x_s, \Omega)} \quad J \text{ is the ray tube } \Omega \text{ and}$$

$$T(x_n, x_s) = \int_{x_s}^{x_n} \frac{dl}{V(x)} \quad \text{travel time}$$

The Fourier transform of equation (5) results in the following equation, $$U_n(x_n, \omega; x_s, t_s) = \frac{1}{\Pi(x_n, x_s)} \frac{1}{\mathcal{R}(x_n, x_s)} \mathcal{F}(\theta, \varphi) U_s(x_s, \omega) e^{-i\omega(t_s + T(x_n, x_s))} \tag{6}$$

or, $$U_s(x_s, \omega) = W_n(x_n, \omega; x_s, t_s) e^{i\omega(t_s + T(x_n, x_s))} \tag{7}$$

where, $$U = \int_{-\infty}^{\infty} u e^{-i\omega t} dt,$$

$$u = \frac{1}{2\pi} \int_{-\infty}^{\infty} U e^{i\omega t} dt, \text{ and}$$

$$W(x_n, \omega; x_s, t_s) = U_n(x_n, \omega; x_s, t_s) \Pi(x_n, x_s) \mathcal{R}(x_n, x_s) / \mathcal{F}(\theta, \varphi).$$

Equation (5) represents the reconstructed source at position $x_s$ from the single receiver at $x_n$. For N number of receivers, the total reconstruction at $x_s$ is $$\sum^{N} U_s(x_s, \omega) = e^{i\omega(t_s + T(x_1, x_s))} \int_{x_1}^{x_n} W_n(x_n, \omega; x_s, t_s) e^{i\omega(T(x_n, x_s) - T(x_1, x_s))} dx_n \tag{8}$$

Here, $x_1$ is the first receiver of the array, $x_N$ is the Nth receiver of the array.

Transforming from space domain to wave number domain $$\int_{x_1}^{x_N} W_n(x_n, \omega; x_s, t_s) e^{i\omega(T(x_n,x_s)-T(x_1,x_s))} dx_n = \int_{-\infty}^{\infty} I w_n(k, \omega; x_s, t_s) e^{-ikx_n} dk$$

where, $$w_n(k, \omega; x_s, t_s) = \frac{1}{2\pi}\int_{-\infty}^{\infty} W_n(x_n, \omega; x_s, t_s) e^{ikx_n} dx_n,$$

$$I = \int_{x_1}^{x_N} e^{-ikx_n} e^{ik\left(V\frac{T(x_n,x_s)-T(x_1,x_s)}{|x_n|}\right)x_n} dx_n, \text{ and}$$

$$k = \frac{2\pi}{\lambda}$$

where each mode of the signal has its own wavelength, λ. An approximation can then be made at high frequency $$\frac{T(x_n, x_s) - T(x_1, x_s)}{|x_n|} \approx \frac{T(x_{mid}, x_s) - T(x_1, x_s)}{|x_{mid}|}$$

where $x_{mid}$ is the mid point of the receiver array.
If $$k_0(\omega) = kV\frac{T(x_{mid}, x_s) - T(x_1, x_s)}{|x_{mid}|},$$

where $V$ is the phase velocity, then $$I = 2\pi\delta(k - k_0(\omega))$$

Using these relations, the contribution of the source at the $x_s$ in the medium from the N observation points can be written as:
Frequency domain:

$$\sum^{N} U_s(x_s, \omega) = 2\pi e^{i\omega(t_s+T(x_n,x_s))} w_n(k_0(\omega), \omega; x_s, t_s),$$

Time domain:

$$\sum^{N} u_s(x_s, \omega) = \int_{-\omega_N}^{\omega_N} e^{i\omega(t_s+T(x_n,x_s))} w_n(k_0(\omega), \omega; x_s, t_s) d\omega$$

Finally, the source contribution at a point xs is given by $$\left|\sum^{N} u_s(x_s, t_s)\right|^2.$$

This represents the strength of the source at the point $x_s$. The holographic method allows more than one source position and their relative strength to be determined from observations at a single array.

A three dimensional display incorporating the above techniques could be constructed to view real time hole positions. Real time viewing helps to delineate actual sources from fictitious sources such as reflectors. A reflector often appears as a source to the receiver array and is initially indistinguishable from a source. However, if as the receivers change position one of the sources seems to be moving, there exists an excellent chance that a reflector rather than a source is present.

Further, amplitude attenuation may be used as a diagnostic to confirm the predicted source location. Since the amplitude of a waveform attenuates as it propagates, the amplitude of a received signal should generally become larger as a receiver or receiver array comes closer to the source location.

While preferred embodiments of this invention have been shown and described, modifications thereof can be made by one skilled in the art without departing from the spirit or teachings of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A method for locating signal source position, comprising:

providing a signal source at a first position;

providing a signal receiver at a second position proximate a wellbore;

transmitting from said signal source an acoustic homing signal;

receiving said homing signal emitted by said signal source at said signal receiver, identifying the position of said signal source based upon the homing signal received at said signal receiver;

extending said wellbore based upon said position of said signal source.

2. The method of claim 1, wherein said wellbore is a second wellbore and said first position is proximate a first wellbore.

3. The method of claim 2, wherein said signal receiver is proximate an end of said second wellbore.

4. The method of claim 1, further comprising the step of providing a second signal receiver, wherein said step of identifying said position of said signal source includes utilizing the difference in arrival times of said homing signal to said first signal receiver and to said second signal receiver.

5. The method of claim 1, wherein said step of identifying includes applying an predetermined estimate of velocity to the Pythagorean theorem to compute source position.

6. The method of claim 1, wherein said step of identifying includes:

dividing the area surrounding said signal receiver into one or more three dimensional volumes;

assigning a propagation velocity to each volume;

selecting a hypothetical source location;

deriving a ray trace between said hypothetical source location and said signal receiver; and calculating travel time from said hypothetical source position to said signal receiver based on said propagation velocities and said ray trace.

7. The method of claim 6, wherein said step of identifying further comprises transforming said homing signal received at said signal receiver into the wave number domain.

8. The method of claim 1, further comprising:

providing a second signal source at a third location, said step of identifying including identifying signal contribution of said signal source and said second signal source.

9. The method of claim 1, wherein said signal source is a swept frequency source.

10. The method of claim 1, wherein said step of identifying includes using signal attenuation as a diagnostic to confirm source location.

11. The method of claim 1, wherein said step of identifying includes eliminating a reflector as a signal source position.

12. A device for locating a subterranean source from a subterranean receiver comprising:

at least one receiver for receiving an acoustic signal;

a filter associated with said receiver to filter said acoustic signal; and, a processor, said processor finding source position from said signal by calculating the ray trace and travel time from at least one hypothetical source position to said at least one receiver.

13. The device of claim 12, wherein said device is an LWD device.

14. The device of claim 12, wherein said device includes at least three receivers.

15. The device of claim 12, wherein said receivers are located along a drill string body.

16. The device of claim 15, wherein said receivers are spaced at equal distances from one another along the drill string body.

17. The device of claim 12 wherein said receiver is located in a blade of a stabilizer.

18. The device of claim 12 wherein said processor provides a signal representative of said source position to a real time display.

19. A method for locating signal source position, comprising:

providing a signal source at a first position;

providing a signal receiver at a second position;

transmitting from said signal source homing signal;

receiving said homing signal emitted by said signal source at said signal receiver, identifying the position of said signal source based upon the homing signal received at said signal receiver, including:

dividing the area surrounding said signal receiver into one or more three dimensional volumes;

assigning a propagation velocity to each volume;

selecting a hypothetical source location;

deriving a ray trace between said hypothetical source location and said signal receiver; and calculating travel time from said hypothetical source position to said signal receiver based on said propagation velocities and said ray trace.

20. A method for locating wellbore position, comprising:

providing a signal source at a first position;

providing a signal receiver at a second position;

transmitting from said signal source homing signal;

receiving said homing signal emitted by said signal source at said signal receiver, identifying the position of said signal source based upon the homing signal received at said signal receiver, including:

transforming said homing signal received at said signal receiver into the wave number domain;

dividing the area surrounding said signal receiver into one or more three dimensional volumes;

assigning a propagation velocity to each volume;

selecting a hypothetical source location;

deriving a ray trace between said hypothetical source location and said signal receiver; and calculating travel time from said hypothetical source position to said signal receiver based on said propagation velocities and said ray trace.

21. A device for locating a subterranean source from a subterranean receiver, comprising:

at least one receiver for receiving an acoustic signal, said receivers being located along a drill string body;

a filter associated with said receiver to filter said acoustic signal; and, a processor, said processor finding source position from said signal.

* * * * *